US007685839B2

(12) United States Patent
Gu

(10) Patent No.: US 7,685,839 B2
(45) Date of Patent: Mar. 30, 2010

(54) REFRIGERATION SYSTEM

(76) Inventor: Junjie Gu, 203 Annapolis Cir., Ottawa, Ontario (CA) K1V 1Z1

( * ) Notice: Subject to any disclaimer, the term of this patent is extended or adjusted under 35 U.S.C. 154(b) by 1053 days.

(21) Appl. No.: 11/177,855

(22) Filed: Jul. 8, 2005

(65) Prior Publication Data

US 2006/0010905 A1 Jan. 19, 2006

Related U.S. Application Data

(60) Provisional application No. 60/586,297, filed on Jul. 9, 2004.

(51) Int. Cl.
*F25B 43/00* (2006.01)

(52) U.S. Cl. ..... 62/503; 62/197; 62/434

(58) Field of Classification Search ..... 62/503, 62/511, 513, 197, 113, 434
See application file for complete search history.

(56) References Cited

U.S. PATENT DOCUMENTS

| | | | | |
|---|---|---|---|---|
| 2,139,110 | A | 12/1938 | Boles | |
| 2,227,537 | A | 1/1941 | Dasher | |
| 2,393,854 | A | 1/1946 | Carpenter | |
| 2,455,298 | A | 11/1948 | Cahenzli, Jr. | |
| 2,467,078 | A | 4/1949 | Cahenzli, Jr. | |
| 2,505,934 | A | 5/1950 | Aughey et al. | |
| 2,520,045 | A | 8/1950 | McGrath | |
| 2,530,648 | A | 11/1950 | Cahenzli, Jr. et al. | |
| 2,960,270 | A | 11/1960 | Long | |
| 2,990,698 | A | 7/1961 | Croster | |
| 3,145,545 | A | 8/1964 | Jaeger | |
| 3,283,524 | A | 11/1966 | Thomson | |
| 3,428,251 | A | 2/1969 | Gross | |
| 3,621,673 | A * | 11/1971 | Foust | 62/503 |
| 3,872,687 | A * | 3/1975 | Bottum et al. | 62/243 |
| 3,955,374 | A * | 5/1976 | Zearfoss, Jr. | 62/197 |
| 3,955,375 | A | 5/1976 | Schumacher | |
| 4,147,037 | A | 4/1979 | Gelbard | |
| 4,150,558 | A | 4/1979 | Pohl | |
| 4,217,765 | A | 8/1980 | Ecker | |
| 4,304,099 | A | 12/1981 | Vakil | |
| 4,367,639 | A | 1/1983 | Kantor | |
| 4,488,413 | A | 12/1984 | Bottum | |

(Continued)

FOREIGN PATENT DOCUMENTS

| | | |
|---|---|---|
| CH | 210 267 A | 6/1940 |

(Continued)

OTHER PUBLICATIONS

Supplementary Partial European Search Report for European Application No. EP05 76 3488 (4 pages), Search completed Jun. 1, 2007.

*Primary Examiner*—Melvin Jones
(74) *Attorney, Agent, or Firm*—Barnes & Thornburg LLP

(57) ABSTRACT

A refrigeration system with integrated accumulator-expander-heat exchanger is disclosed. Refrigerant from a condenser/gas cooler is throttled through a capillary tube while at the same time undergoing a heat exchanging process with refrigerant from an evaporator. This method can elevate the compressor efficiency, increase the specific cooling capacity, and enhance the system performance. The capillary tube, which has dual functions of expansion device and heat exchanger, is placed inside a canister which also functions as an accumulator. The new device combining three separate parts into one can simplify the manufacturing process, lower the system size and weight, and thus decrease cost of the whole system.

30 Claims, 11 Drawing Sheets

U.S. PATENT DOCUMENTS

| | | | |
|---|---|---|---|
| 4,646,527 | A | 3/1987 | Taylor |
| 5,228,308 | A | 7/1993 | Day et al. |
| 5,245,833 | A | 9/1993 | Mei et al. |
| 5,269,459 | A | 12/1993 | Thompson et al. |
| 5,289,699 | A | 3/1994 | Nivens |
| 5,457,966 | A | 10/1995 | Nivens |
| 5,622,055 | A | 4/1997 | Mei et al. |
| 6,185,957 | B1 | 2/2001 | Voss |
| 6,298,687 | B1 | 10/2001 | Dienhart et al. |
| 6,463,757 | B1 | 10/2002 | Dickson et al. |
| 6,523,365 | B2 | 2/2003 | Zhang et al. |
| 6,530,230 | B2 | 3/2003 | Makizono et al. |
| 6,681,597 | B1 | 1/2004 | Yin et al. |
| 2005/0069442 | A1 | 3/2005 | Cho et al. |
| 2005/0081559 | A1 | 4/2005 | McGregor et al. |
| 2005/0103046 | A1 | 5/2005 | Heyl et al. |
| 2005/0178146 | A1 | 8/2005 | Muta et al. |
| 2005/0178151 | A1 | 8/2005 | Matsumoto et al. |
| 2005/0178523 | A1 | 8/2005 | Itoh et al. |
| 2005/0183451 | A1 | 8/2005 | Roston |
| 2005/0189431 | A1 | 9/2005 | Nakayama et al. |
| 2005/0191198 | A1 | 9/2005 | Sato |
| 2005/0217312 | A1 | 10/2005 | Arno et al. |
| 2005/0226735 | A1 | 10/2005 | Funami et al. |
| 2005/0254977 | A1 | 11/2005 | Aya et al. |
| 2005/0257547 | A1 | 11/2005 | Hirao et al. |
| 2005/0262870 | A1 | 12/2005 | Narayanumurthy et al. |
| 2005/0262873 | A1 | 12/2005 | Hirota |
| 2005/0268644 | A1 | 12/2005 | Oshitani et al. |
| 2005/0274140 | A1 | 12/2005 | Komatsu et al. |
| 2005/0279127 | A1 | 12/2005 | Jia et al. |
| 2006/0000232 | A1 | 1/2006 | Bureau et al. |
| 2006/0005557 | A1 | 1/2006 | Takano et al. |
| 2006/0005558 | A1 | 1/2006 | Otake et al. |
| 2006/0005570 | A1 | 1/2006 | Yamada et al. |
| 2006/0008360 | A1 | 1/2006 | Nishikawa et al. |
| 2006/0016214 | A1 | 1/2006 | Gorbounov et al. |

FOREIGN PATENT DOCUMENTS

| | | | |
|---|---|---|---|
| DE | 14 51 039 | A1 | 3/1969 |
| FR | 2 528 157 | A3 | 12/1983 |
| FR | 2 836 542 | A1 | 8/2003 |
| GB | 16179 | A | 7/1914 |
| JP | 58 016153 | A | 1/1983 |
| JP | 11 002474 | A1 | 1/1999 |
| JP | 2002 267278 | A | 9/2002 |
| JP | 2004-028525 | | 1/2004 |
| JP | 2004 028525 | A1 | 1/2004 |

* cited by examiner

REFRIGERATION SYSTEM

CROSS-REFERENCE TO RELATED APPLICATIONS

This application claims priority from U.S. Provisional Patent Application No. 60/586,297 filed on 9 Jul, 2004.

FIELD OF THE INVENTION

The present invention relates generally to refrigeration systems with a heat exchanger, and more particularly but not limited to transcritical systems used in automobile vehicles, e.g. in the form of $CO_2$ air conditioners.

BACKGROUND OF THE INVENTION

Closed-loop refrigeration/heat pump systems conventionally employ a compressor that is meant to draw in vaporous refrigerant at relatively low pressure and discharges hot refrigerant at relatively high pressure. The hot refrigerant is then cooled in a gas cooler if the pressure and temperature are higher than values of temperature and pressure at the critical point, otherwise it condenses into liquid, and the gas cooler is called a condensers, accordingly. "Critical point" is a physical property of pure substances defined by temperature and pressure. Above the critical point, the substance is in a supercritical state and comprises a supercritical fluid which is neither gas nor liquid.

Together with a compressor, an expansion device, which typically comprises an expansion valve, or in some cases may comprise one or plurality of capillary tube(s), divides the system into high and low pressure sides. The working fluid passes through the expansion device into an evaporator, and as it passes through the expansion device the fluid expands and cools. The fluid typically enters the evaporator in a liquid-rich state, and thereafter absorbs heat and evaporates. At low heat loads in certain working conditions it is not possible to evaporate all the liquid. Some amount of liquid refrigerant is used to dilute cycling oil and carry it back to the compressor. However, a large amount of liquid is undesirable because system efficiency could be lowered and the compressor could be significantly damaged if a large amount of liquid refrigerant enters the compressor (known as "liquid slugging"). Therefore, it is preferable to place an accumulator between the evaporator and the compressor to separate vapour and liquid and store the excess liquid. Accumulators have a metering function of collecting liquid and returning a certain amount to the compressor. This prevents liquid slugging and controls oil return. It is particularly important in automobile air conditioning systems, where surges of liquid refrigerant occur frequently because of the varying dynamic operating conditions. Moreover, use of an accumulator can elevate the efficiency of the evaporator in that dry coils, employed in traditionally operated evaporators, are not required.

Transcritical refrigerating systems operate in a range of temperature and pressure that cross the critical point of the refrigerant. In these systems, for refrigerants with relatively low critical temperatures, e.g. carbon dioxide which has a critical temperature of 31.7° C., it is difficult to reach a high specific cooling capacity and this is a significant barrier for achieving a high coefficient of performance (COP). To overcome this limitation, an internal heat exchanger is used that exchanges heat between refrigerants of different parts; one which connects the condenser/gas cooler and expansion device, and the other which connects the evaporator and compressor. This method is described in U.S. Pat. No. 5,245,833, 6,523,365 and 6,681,597.

Another feature of a known refrigeration system is the inclusion of the expander in the accumulator-heat exchanger system (U.S. Pat. Nos. 5,622,055 and 6,530,230). However, in U.S. Pat. No. 6,530,230, an expansion device is simply assembled at the inlet of accumulator-heat exchanger without being functionally integrated.

In U.S. Pat. No. 5,622,055, an expander, a heat exchanger, and an accumulator are integrated into a canister. However, those explorations focus only on subcritical refrigerants. The characteristics of trans-/hypercritical alternatives were not considered; accordingly, a phase change from supercritical fluid to liquid which occurs in trans-hypocritical systems was not taken into account in the expander design. Additionally, the capillary coils were required to be immersed in the liquid-phase of the accumulator. This will not increase the specific cooling capacity, and the extra circulating refrigerant needed will consume more energy. As a result, the whole system performance might not be improved significantly. Furthermore, the heat gain from environment between the evaporator outlet and the inlet of compressor (including accumulator) will decrease the system COP.

SUMMARY OF THE INVENTION

According to one aspect of the present invention, there is provided an apparatus for a refrigeration system comprising an accumulator having a chamber for receiving refrigerant, an enclosure in said chamber, said enclosure being defined by an enclosure wall and having a fluid inlet and a fluid outlet, and an expander for expanding refrigerant and disposed in said enclosure, wherein said expander comprises a conduit for carrying refrigerant therethrough, said conduit having an impedance over at least a portion of its length to produce a pressure drop in fluid therealong.

In this arrangement, the expansion device comprises a conduit whose wall provides a heat exchange surface so that, for example, refrigerant flowing through the expansion conduit to an evaporator of the refrigeration system can exchange heat with refrigerant flowing from the evaporator to a compressor. Positioning the expansion conduit within an enclosure in the accumulator chamber at least partially isolates the expansion conduit from liquid refrigerant in the accumulator chamber and allows refrigerant flowing through the conduit to exchange heat predominantly with gaseous and/or two-phase refrigerant received from the evaporator of the refrigeration system. This arrangement both obviates the need for a separate expansion device, thereby allowing the refrigeration system to be more compact, and promotes a heat exchange process which assists in preventing liquid refrigerant flowing into the compressor. This arrangement also reduces the evaporation of liquid refrigerant in the accumulator so that more liquid is available in the evaporator, thereby increasing the efficiency and cooling capacity of the refrigeration system. As the system does not depend on any heat exchange with liquid refrigerant in the accumulator, the present arrangement is particularly suitable for use with transcritical refrigerants such as $CO_2$ in which liquefaction of the refrigerant is more difficult than other more conventional refrigerants.

In some embodiments, the conduit has an impedance which is distributed over a substantial portion of its length in the enclosure and in one embodiment may comprise a capillary tube. Generally, the expansion conduit provides a sufficient impedance to produce a sufficient pressure drop in fluid flowing therethrough for introduction into an evaporator.

In some embodiments, the apparatus further comprises separating means for separating refrigerant gas from refrigerant liquid and for introducing refrigerant gas into the inlet of the enclosure. The separating means may comprise a fluid inlet for introducing fluid into the chamber, and which is positioned to prevent fluid flowing through the inlet from flowing directly into the inlet of the enclosure. Thus, liquid can accumulate in a lower portion of the chamber, and gaseous refrigerant may be drawn into the enclosure inlet from the space above the liquid.

In some embodiments, the enclosure is in the form of a conduit and the expansion conduit extends along the length of the enclosure conduit so that gaseous and/or two phase refrigerant from the chamber flows over the surface of the conduit to promote heat exchange with high pressure refrigerant flowing through the expansion conduit.

In some embodiments, the apparatus may further comprise an expansion device defining one or more restrictive orifices sized to increase the impedance of fluid flow above the impedance provided by the expander conduit. Advantageously, the addition of an orifice-type expansion device which contributes to the overall impedance of the combination allows the impedance of the expander conduit to be relaxed or reduced. In turn, this allows the cross-sectional area, and therefore the surface area of the expander conduit to be increased for improved heat exchange with refrigerant flowing from the evaporator to a compressor of a refrigeration system. Alternatively, or in addition, this arrangement allows the length of the expansion conduit to be reduced, thereby enabling the expansion conduit to be more compact.

In some embodiments, the apparatus further comprises valve means for varying the size of at least one orifice of the expansion device. Advantageously, this allows the impedance of the combination expander and therefore the temperature of the refrigerant at the inlet of the evaporator to be controlled. Therefore, the valve means allows the cooling capacity of a refrigeration system to be controlled independently of compressor speed. This is particularly beneficial in automotive air conditioning systems where the compressor is driven by the engine and therefore the compressor speed depends on the speed of the vehicle. For example, the compressor speed will be low when the vehicle is idling but the heat load on the system may remain constant. In this case, the reduction in cooling capacity resulting from a lower compressor speed can be compensated by controlling the valve means to increase the pressure drop across the combination expander, thereby reducing the temperature of refrigerant at the inlet of the evaporator and increasing the cooling capacity of the system.

In some embodiments, the valve means is responsive to a parameter such as temperature or pressure to vary the size of the orifice. The valve means may comprise structure which displaces as a result of changes in temperature of the structure. Advantageously, this allows the valve means to automatically open and close in response to local temperature changes, such as temperature changes at the inlet of the evaporator.

In some embodiments, the structure comprises an element capable of assuming a curve along its length, and wherein a tightness of an assumed curve is varied by temperature such that the tightness of curvature is varied in a plane which extends across the orifice. Advantageously, this arrangement provides a compact and robust means of operating the orifice valve.

In some embodiments, the element comprises a first element comprising a first material and a second element comprising a second material, wherein the first material has a different coefficient of thermal expansion than that of the second material, and the elements are positioned side by side in the plane. In some embodiments, the element comprises an elongate strip formed as a spiral.

In some embodiments, the apparatus further comprises a conduit for carrying fluid from the accumulator to a compressor and a return conduit for feeding fluid from the compressor to the accumulator, and wherein the further and return conduits are in heat exchange relationship. This arrangement allows additional heat exchange between fluid flowing to the compressor and fluid flowing from the compressor in the portion of the refrigeration circuit between the accumulator and compressor (e.g. between a cooler/condenser of the system and the accumulator) to improve the efficiency of the system. The further and return conduits may be in contact with one another and/or one conduit may be inside the other to effect heat exchange between fluids flowing therethrough. In some embodiments, the return conduit may provide an impedance along at least a portion of its length, and may, for example, comprise a capillary tube, and may simply be an extension of the expander conduit in the accumulator chamber. In another embodiment, an accumulator may be omitted altogether and the arrangement may simply comprise two conduits in heat exchange relationship, one of which carries fluid to the evaporator, and the other carries fluid from the evaporator to the compressor. In one embodiment, at least a portion of the conduit carrying fluid to the evaporator may comprise an expansion conduit, i.e. a conduit which performs expansion of the fluid and has an impedance over at least a portion of its length to produce a pressure drop in fluid therealong. This embodiment may additionally be combined with an expansion device. On the other hand, the conduit carrying fluid to the evaporator may perform none or little expansion of the fluid and a separate expansion device may be provided between the conduit and evaporator.

Advantageously, this arrangement provides a simple heat exchanger for enabling heat to be exchanged between fluid flowing to and from the evaporator of a refrigeration system.

According to another aspect of the present invention, there is provided an apparatus for a refrigeration system comprising an accumulator having a chamber for receiving refrigerant; an expander for expanding refrigerant and disposed in said chamber, wherein said expander comprises a conduit for carrying refrigerant therethrough, said conduit having an impedance over at least a portion of its length to produce a pressure drop in fluid therealong, and wherein said conduit is arranged in said chamber such that a major part of the surface area of the conduit in said chamber is positioned for heat exchange with gaseous and/or two-phase refrigerant.

In this arrangement, the conduit acts as an expansion device and at the same time is arranged for heat exchange predominantly between refrigerant flowing to the evaporator and gaseous or two-phase refrigerant flowing from the evaporator to a compressor of a refrigeration system. In this embodiment, the conduit may be arranged such that a major part of the surface area of the conduit is disposed in an upper portion of the chamber or above a level of liquid refrigerant in the chamber so that heat exchange is predominantly with gaseous and/or two-phase refrigerant.

In some embodiments, the apparatus further comprises an enclosure in the chamber, the enclosure being defined by an enclosure wall and having a fluid inlet and a fluid outlet, and wherein the major surface of the conduit is in heat exchange relationship with the interior of the enclosure.

In some embodiments, the expander conduit is disposed in the enclosure.

In some embodiments, the enclosure comprises a conduit. Advantageously, the conduit provides a means of directing fluid from the evaporator along the expansion conduit so that the resulting flow of fluid from the evaporator can continuously absorb heat and possibly increase in temperature so that the fluid entering the compressor is in a super heated rather than saturated state.

According to another aspect of the present invention, there is provided an apparatus for a refrigeration system comprising an accumulator having a chamber for receiving refrigerant, and expansion means for expanding refrigerant, the expansion means comprising a conduit for carrying fluid therethrough and being arranged for exchanging heat with refrigerant in said chamber, said conduit having an impedance over at least a portion of its length to produce a pressure drop in fluid therealong, said expansion means further comprising means for defining one or more restrictive orifice sized to increase the impedance of fluid flow above the impedance provided by said conduit.

In this arrangement, the expander for expanding refrigerant comprises a combination of a conduit having an impedance for producing a pressure drop in fluid therealong and means defining one or more restrictive orifices which also provide an impedance. As the impedance is shared between an expansion conduit and an orifice type expansion device, the impedance of the expansion conduit may be reduced or relaxed as compared to an embodiment in which the expansion device solely comprises an expansion conduit. This allows the cross-sectional area, and therefore the surface area of the expansion conduit to be increased, thereby increasing the surface area over which heat exchange can take place for increased efficiency.

In some embodiments, the apparatus further comprises valve means for varying the size of at least one orifice.

According to another aspect of the present invention, there is provided an apparatus for a refrigeration system comprising an accumulator having a chamber for receiving refrigerant, an expander for expanding refrigerant comprising a conduit for carrying fluid therethrough, said conduit having an impedance over at least a portion of its length to produce a pressure drop in fluid therealong, and control means for controlling the impedance of the expander.

In this arrangement, the expander comprises a conduit which advantageously allows the expander to perform heat exchange as well as expansion of refrigerant into an evaporator, and the control means allows the impedance of the expander to be controlled, thereby enabling the temperature of the refrigerant at the inlet of the evaporator and the cooling capacity of the evaporator to be controlled.

In some embodiments, the control means comprises valve means for controlling the flow of fluid therethrough.

In some embodiments, the apparatus further comprises an enclosure being defined by an enclosure wall and having a fluid inlet and a fluid outlet, and wherein the expander conduit is disposed in the enclosure. This arrangement allows heat exchange between liquid in the accumulator and refrigerant in the expansion conduit to be reduced and promotes heat exchange with gaseous and/or two-phase refrigerant from the evaporator so that liquid in the refrigerant flowing from the evaporator can be removed before the fluid enters the compressor.

According to another aspect of the present invention, there is provided a refrigeration system comprising an evaporator and a compressor, a first conduit for feeding fluid compressed in the compressor to the evaporator, and a second conduit for feeding fluid from the evaporator to the compressor, wherein said first and second conduits are in heat exchange relationship, and said first conduit has an impedance along at least a portion of its length for expanding said fluid as the fluid flows therealong towards said evaporator.

According to another aspect of the present invention, there is provided a refrigeration system comprising an evaporator and a compressor, a first conduit for feeding fluid compressed in the compressor to the evaporator and a second conduit for feeding fluid from the evaporator to the compressor wherein the first and second conduits are in heat exchange relationship and the system is without an accumulator between the evaporator and compressor.

According to another aspect of the present invention, there is provided an expansion device for a refrigeration system, the expansion device having one or more restrictive orifices, valve means for varying the size of at least one orifice, wherein the valve means comprises an element capable of assuming a curve along its length and wherein the tightness of an assumed curve is varied by temperature such that the tightness of the curvature is varied in a plane which extends across the orifice.

In some embodiments, the element comprises a first element comprising a first material and a second element comprising a second material, wherein the first material has a different coefficient of thermal expansion than that of the second material, and the elements are positioned side by side in the plane.

In some embodiments, the element comprises an elongate strip formed as a spiral.

In some embodiments, the element is mounted such that the element overlaps the orifice to vary the size of the orifice in response to changes in temperature.

One embodiment of the present invention provides an integrated accumulator-expander-heat exchanger. In some embodiments, accumulators can be characterized as having three regions: a gas-phase region, a liquid-phase region and a two-phase region. From an energy utilization point of view, the expansion tube(s) should be placed in the two-phase region and/or gas-phase region of the accumulator-expander-heat exchanger, to heat the refrigerant to a temperature close to or higher than the ambient so that the irreversible loss of the system to the external environment decreases and the larger specific cooling capacity will increase the system COP. In embodiments of the present invention, the expansion tube(s) can be immersed in liquid, but exchanging heat with the two-phase and/or gas-phase fluid is preferred. A superheated gas can then be supplied to the compressor.

In accordance with embodiments of the present invention, the high temperature refrigerant from the high pressure side is sub-cooled to lower temperatures on passage through the expansion conduit, and the expansion conduit simultaneously effects expansion of the refrigerant to a lower quality (liquid richer) state, compared with conventional cycles for the introduction into the evaporator. In addition, this brings vaporous refrigerant generated in the evaporator or in the accumulator-expander-heat exchanger to a higher quality or even a superheated gaseous state for return to the compressor, which will increase the COP of compressor.

The refrigeration system is primarily for use in refrigerators, freezers, air-conditioners, and heat pumps, particularly in automotive air-conditioning systems, but may be used in any other systems.

BRIEF DESCRIPTION OF THE DRAWINGS

Examples of embodiments of the present invention will now be described with reference to the drawings, in which.

DESCRIPTION OF EMBODIMENTS

Figure 1:
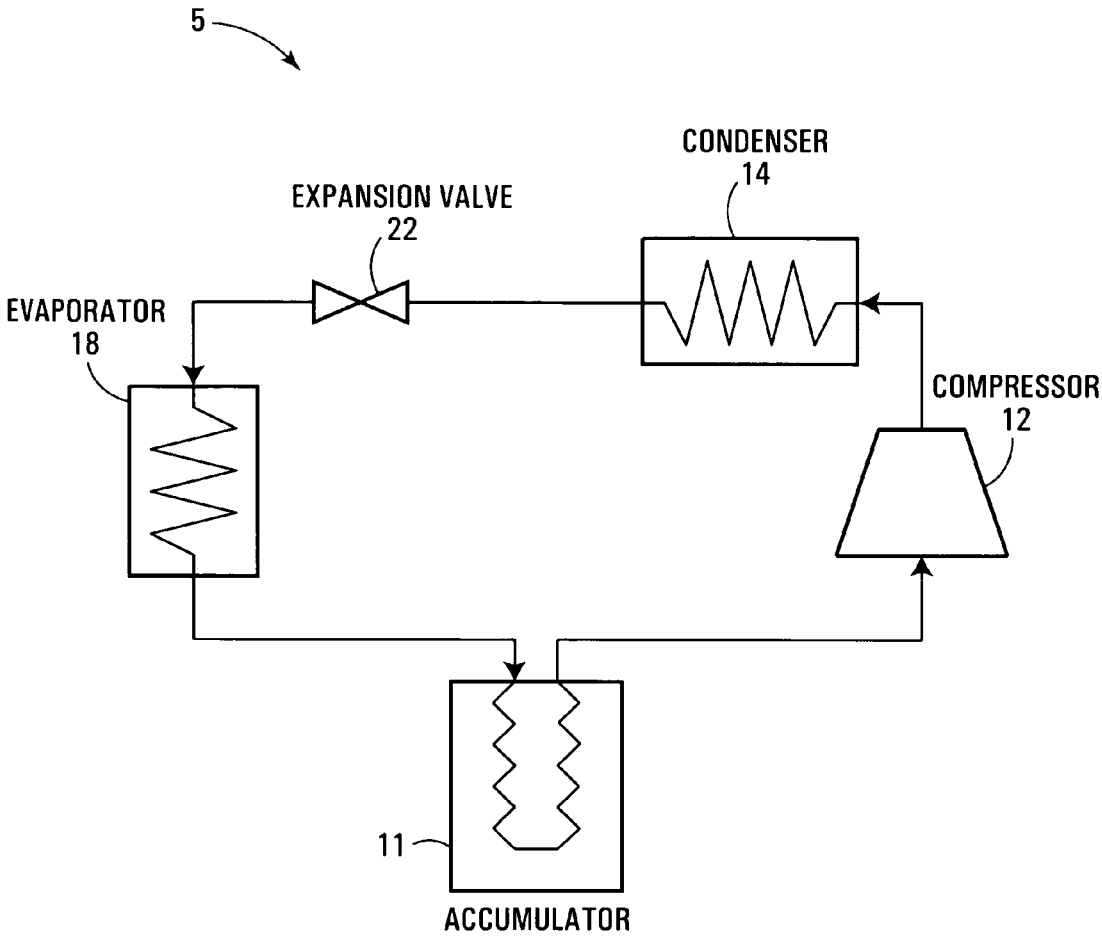
FIG. 1 (PRIOR ART)
FIG. 1 is a schematic flow diagram of a conventional air-conditioning system.

In a conventional air-conditioning system 5 of FIG. 1, liquid refrigerant is stored in an accumulator 11 to be drawn in gaseous-liquid two-phase form to the inlet of a compressor 12. The compressor 12 delivers high temperature—high pressure refrigerant gas (i.e. substantially higher than ambient) to a condenser/gas cooler 14 where the gas is cooled and/or typically partially converted to a liquid form. Refrigerant fluid from the condenser 14 (still under high pressure) is expanded to a lower pressure through an expansion device 22, thereby undergoing a rapid drop in temperature; the low temperature low pressure fluid is then evaporated in an evaporator 18 from where it is returned to the accumulator 11 in a mixed flow of liquid and gas. Depending upon the loading of the system, more or less refrigerant fluid is condensed and evaporated; refrigerant that is in excess of the instantaneous requirements of the system is stored in liquid form in the accumulator 11. The compressor, condenser, expansion device and evaporator together with the conduits which interconnect these components form a refrigerant loop for the refrigeration system.

Figure 2:
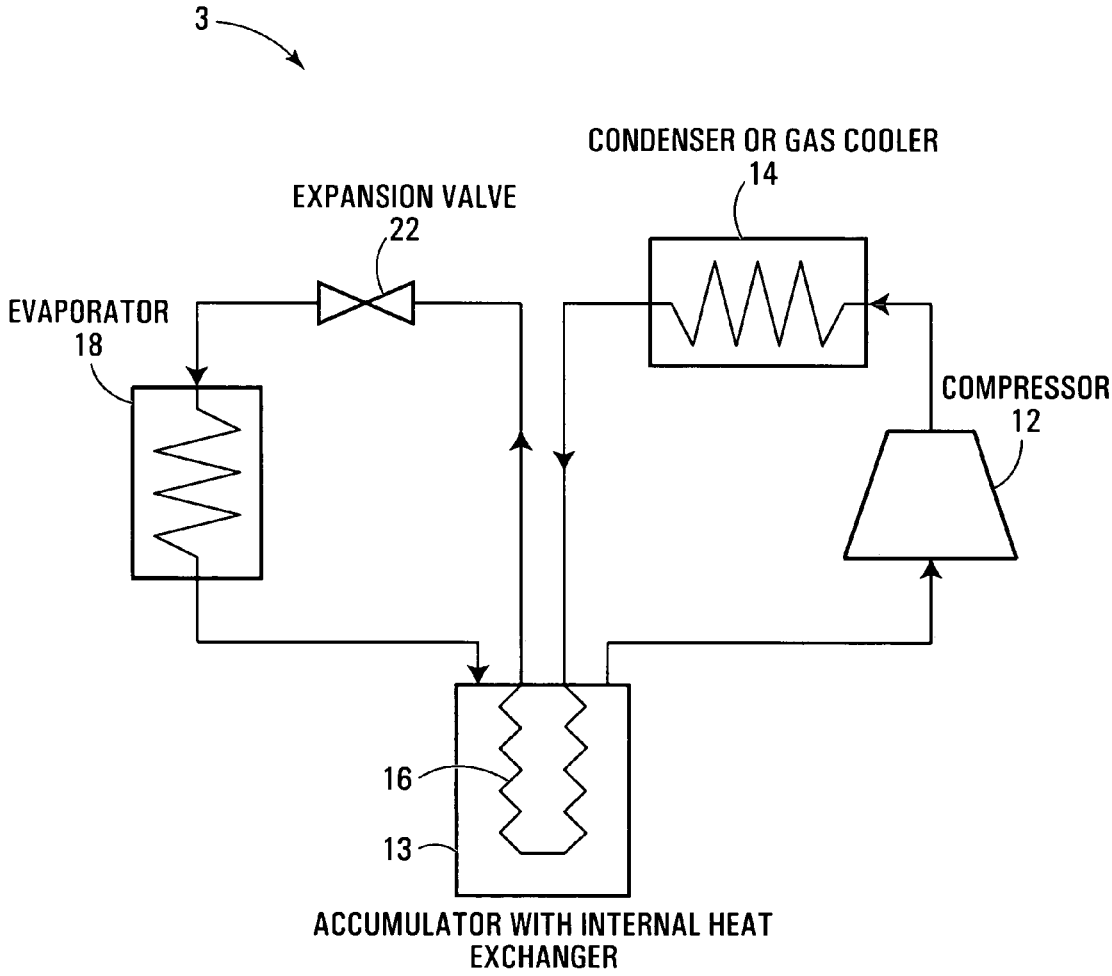
FIG. 2 (PRIOR ART)
FIG. 2 is a schematic flow diagram of a known air-conditioning system using an accumulator with internal heat exchanger.

FIG. 2 shows a known air-conditioning system 3 using an accumulator with internal heat exchanger 13, which modifies the conventional system 5 of FIG. 1 by directing the partially cooled refrigerant fluid delivered from the condenser 14 through a heat exchange coil 16 in the accumulator 13.

Figure 3:
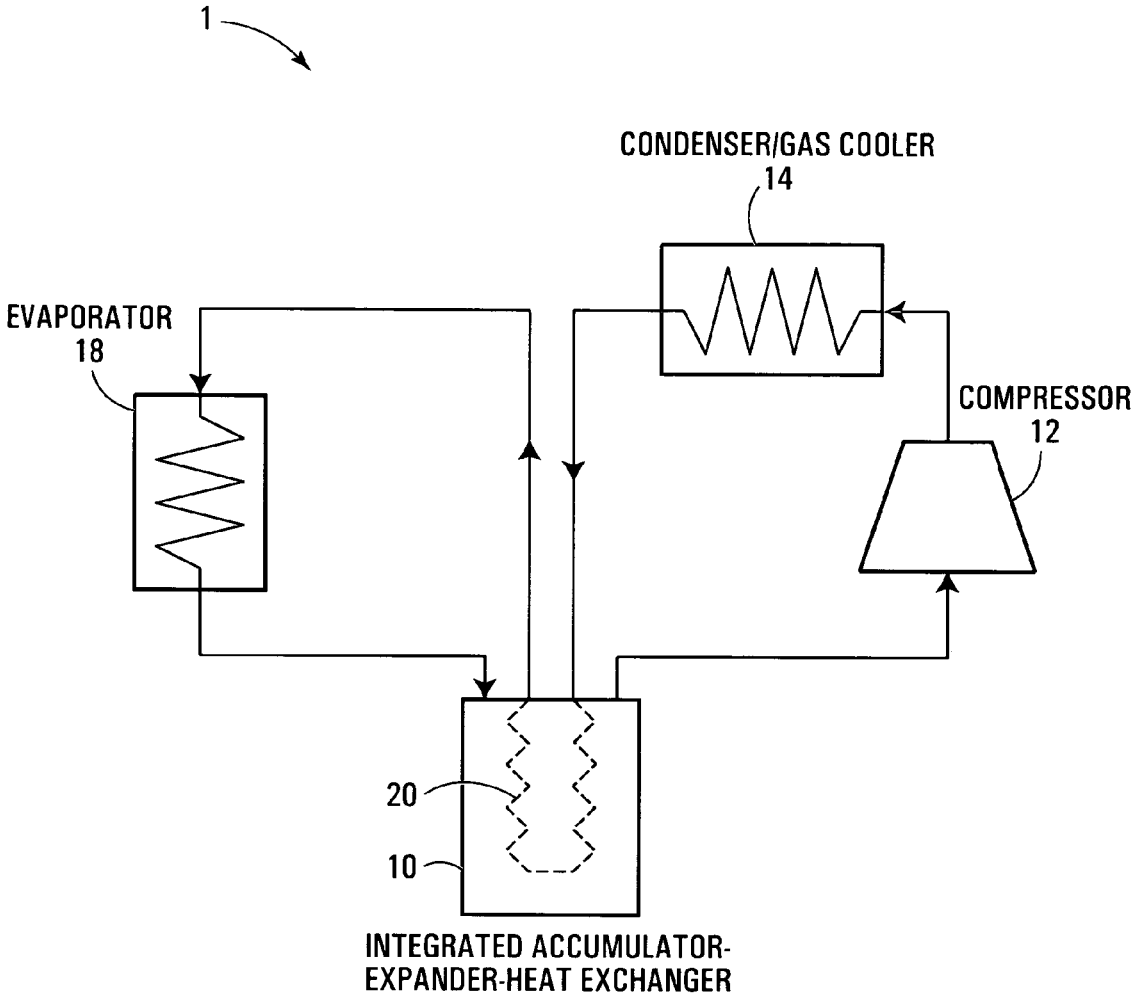
FIG. 3 is a schematic flow diagram of an air-conditioning system (which maybe used for cooling or for heating) using an integrated accumulator-expander-heat exchanger of an embodiment of the present invention.

An air-conditioning system 1 of an embodiment of the present invention shown in FIG. 3 generally comprises a conventional refrigerant compressor 12, a condenser 14 and an evaporator 18 which are operatively coupled together by a conduit arrangement which includes a length of capillary tube or conduit 20, disposed between the condenser 14 and the evaporator 18, and housed within an integral accumulator-expander-heat exchanger assembly 10.

The embodiment shown in FIG. 3 modifies the system of FIG. 2 by using a capillary tube 20 placed within the accumulator 10 to perform the functions of internal heat exchanger 16 and the expansion device 22 shown in FIG. 2. As is more fully described hereinafter, the capillary tube 20 is placed in an inner tube and preferably not in contact with the refrigerant liquid in the accumulator 10, but rather is positioned to be contacted by refrigerant vaporous-liquid two phase and/or refrigerant gas that is withdrawn from the accumulator 10 by the compressor 12. The purpose of capillary tube 20 is to provide a heat transfer interface to pre-cool the high pressure refrigerant and to ensure complete vaporization of the refrigerant delivered to the compressor 12.

Figure 4:
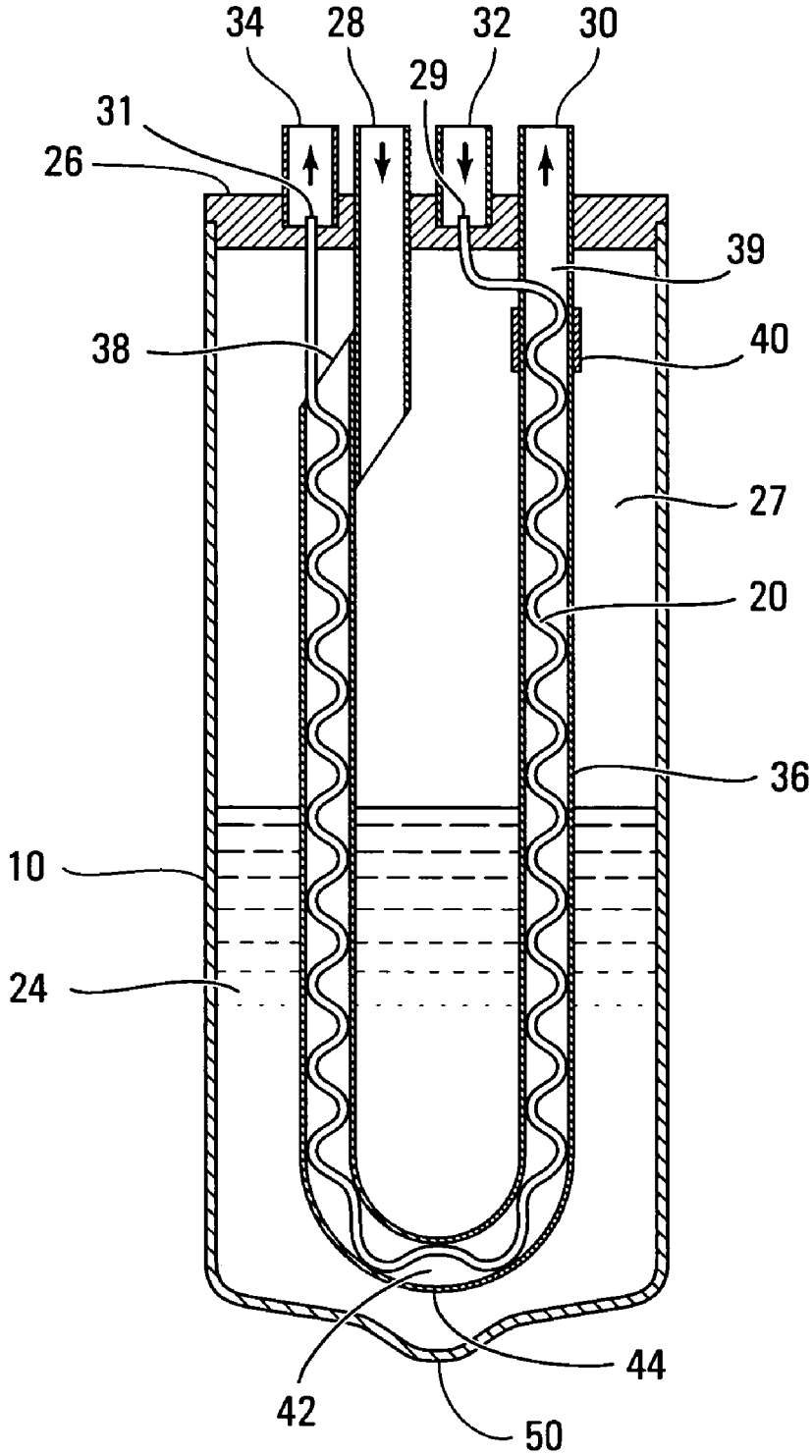
FIG. 4 is a cross-sectional view of an integrated accumulator-expander-heat exchanger of a first embodiment of the present invention.

The structure of an embodiment of the accumulator 10 is more clearly shown in FIG. 4 and comprises a cylindrical container 24, the upper end of which is attached and preferably hermetically sealed to a disc-shaped head fitting 26. Other shapes of the container 24 and the head fitting 26 and other sealing means are contemplated by embodiments of the invention. The container 24 and the head fitting 26 together define a chamber 27 which includes a plurality of ports to receive the following connections: a low pressure inlet port 28 to deliver refrigerant fluid from the evaporator; a low pressure outlet port 30 through which refrigerant gas is passed from the accumulator to the compressor 12; a high pressure inlet port 32 and a low pressure (after expansion) outlet port 34 communicating with the capillary tube 20 for delivering the refrigerant fluid from the condenser/gas cooler 14 to the evaporator 18. The low pressure inlet port 28, the low pressure outlet port 30, the high pressure inlet port 32 and the high pressure outlet port 34 on head fitting 26 may be placed in any suitable arrangement or configuration depending on the space of head fitting 26 and convenience of manufacture.

The container 24 preferably has a sump 50, which may be formed in a central region of the bottom of the chamber 27. The sump 50 collects and stores oil, which is used to lubricate the compressor and other components of the refrigeration system.

An enclosure, which in this embodiment has the form of a tube 36 with a vapor inlet end 38 and a low pressure outlet end 39 is positioned inside the cylindrical container 24. In this embodiment, the tube 36 is an aluminum cylindrical J-tube formed in two longitudinal halves which are welded together after the capillary tube 20 is inserted into the tube 36. However, the tube 36 may have any other desirable shape, including linear, and may be formed from any suitable materials such as stainless steel or copper, or a polymeric material such as a plastic material. A short tube 40 is connected (e.g. welded) to the outside of tube 36 surrounding the low pressure outlet end 39 for welding two parts of tube 36 together after the capillary tube 20 is inserted into the tube 36. The tube 36 extends generally vertically from the low pressure outlet port 30 into the lower portion of the container 24 and is curved in the region of its lowest point 42. The tube 36 extends upwardly from the lowest point 42 to the inlet end 38. The tube 36 further preferably has one or more oil bleeding holes 44 in the curved portion of the tube, which allow small amounts of oil to be drawn out of the sump 50 and into the tube where the oil is mixed with gaseous refrigerant.

A capillary tube 20, one end 29 of which is connected to the high pressure inlet port 32 and the other end 31 of which is connected to the high pressure outlet port 34, is positioned inside the container 24. The capillary tube 20 enters the tube 36 adjacent the low pressure outlet end 39 and exits the tube 36 adjacent the vapor inlet end 38 such that substantially all of the capillary tube 20 is arranged inside the tube 36. This helps to ensure that the capillary tube is in direct contact with the gasous/two-phase refrigerant rather than the liquid refrigerant, and that the refrigerant flows along the capillary tube over a substantial portion of its length to promote efficient heat exchange. The tube 36 is preferably 50% immersed in liquid refrigerant, but this amount may vary substantially, depending on such factors as the heat load and operation of the system. Inside the tube 36 there is gaseous refrigerant with a little liquid from the bleeding hole(s) 44.

The capillary tube 20 may have any desired cross sectional shapes, such as circular, elliptic, rectangular or other forms. The capillary tube 20 may be in any desired shape, such as the shape of wave, helix and straight line, or any combination of them. The capillary tube 20 may be formed from any suitable material including but not limited to copper, stainless steel, or aluminum. Preferably the capillary tube 20 is circular in cross sectional shape, helix/wavy in shape and is formed of copper. The capillary tube 20 may also be comprised of multiple tubes or coaxial tubes. In one embodiment, a coaxial tube is formed by an internal tube and external tube with internal ridges thereon. In another embodiment, a coaxial tube is formed by an external tube and an internal tube with external ridges thereon. The capillary tube 20 provides an impedance to flow.

In operation, the accumulator 10 is placed into an air conditioning or refrigeration system such as that shown in FIG. 3, in connection with which the refrigerant flow scheme has already been discussed. Therefore, only the flow passing through the accumulator 10 will now be specifically described. The arrows in FIG. 4 illustrate the flow of refrigerant through the accumulator 10 and the capillary tube 20. From the condenser/gas cooler 14 (FIG. 3), the high temperature liquid/vapor refrigerant flows into the accumulator 10 through the high pressure inlet port 32, and then into the capillary tube 20 where it expands and rejects heat to the low temperature refrigerant outside and is discharged at the outlet port 34 into the evaporator 18 (FIG. 3). Simultaneously, the primarily vaporous refrigerant exits the evaporator 18 and flows into the low pressure inlet port 28 of the container 24. Liquid refrigerant accumulates at the bottom of the container 24, and the vaporous refrigerant, which is drawn by the compressor, rises and enters the vapor inlet end 38 of the tube 36. The vaporous refrigerant flows through the tube 36 and carries liquid refrigerant and oil from the oil bleeding hole(s) 44 in the curved portion of the tube 36 and then they mix into a two-phase flow. The vaporous and two-phase refrigerant in the tube 36 absorb heat from the high pressure (capillary tube) side, while high temperature refrigerant is passing through the capillary tube 20. The low pressure, low temperature two-phase fluid or superheated refrigerant is then drawn out of the accumulator 10 through the low pressure outlet port 30 and flows to the compressor 12 (FIG. 3).

The optimized effect for both expansion and heat exchange is achieved by properly selecting the inner diameter and length of capillary tube 20 and the size of conduit (typically ½-1½ inches) connecting the evaporator to the compressor according to certain working conditions, e.g. cooling capacity and working temperature. The capillary tube 20 has a sufficiently small inner diameter and sufficiently long length to effect sufficient expansion of the high pressure refrigerant to low pressure to obtain the required state of refrigerant at the inlet of the evaporator 18, for example mostly liquid with little or no vapour (i.e. a low quality state).

The capillary tube 20 may have an inner diameter in the range of about 0.6 to 2.5 mm (0.025 to 0.100 inch) and a length in the range of about 0.3 to 6 m (1 to 20 feet). For automobile systems the heat transfer area of the capillary tube must be sufficient for system requirements. When the length is relatively long, a compact arrangement should be considered, such as coiled tubes.

The sub-cooling process of the refrigerant in the container 24 is sufficient to provide the refrigerant in the capillary tube 20 with a temperature at least 10 Celsius lower than the temperature of the refrigerant at the outlet of the condenser/gas cooler 14. Depending on the selection of capillary tube 20 in different situations, the sub-cooled temperature of refrigerant changes accordingly and falls into the range of about 10 to 25 Celsius when the discharge temperature of the condenser/gas cooler 14 is about 10 to 20 Celsius above ambient temperature.

Advantageously, arranging the expansion tube 20 in an enclosure such as the conduit 36 ensures that heat is predominantly exchanged between refrigerant in the expansion tube and gaseous rather than liquid refrigerant from the evaporator. Thus, in contrast to the system disclosed in U.S. Pat. No. 5,622,055, the present system does not rely on liquid refrigerant to cool the refrigerant in the expansion tube, so that there is no demand on the present system to produce additional amounts of liquid for this purpose. This allows all of the liquid produced to be available to the evaporator for cooling, thereby improving the cooling capacity of the system. This is particularly beneficial in transcritical systems (e.g. which use cool refrigerant), where liquefaction is more difficult to achieve than in non-transcritical systems. Furthermore, as the present system allows the refrigerant entering the compressor to be in a superheated, rather than saturated state, the outlet temperature of the compressor and therefore the temperature difference across the cooler/condenser can be higher, resulting in a more efficient refrigeration cycle.

Figure 5:
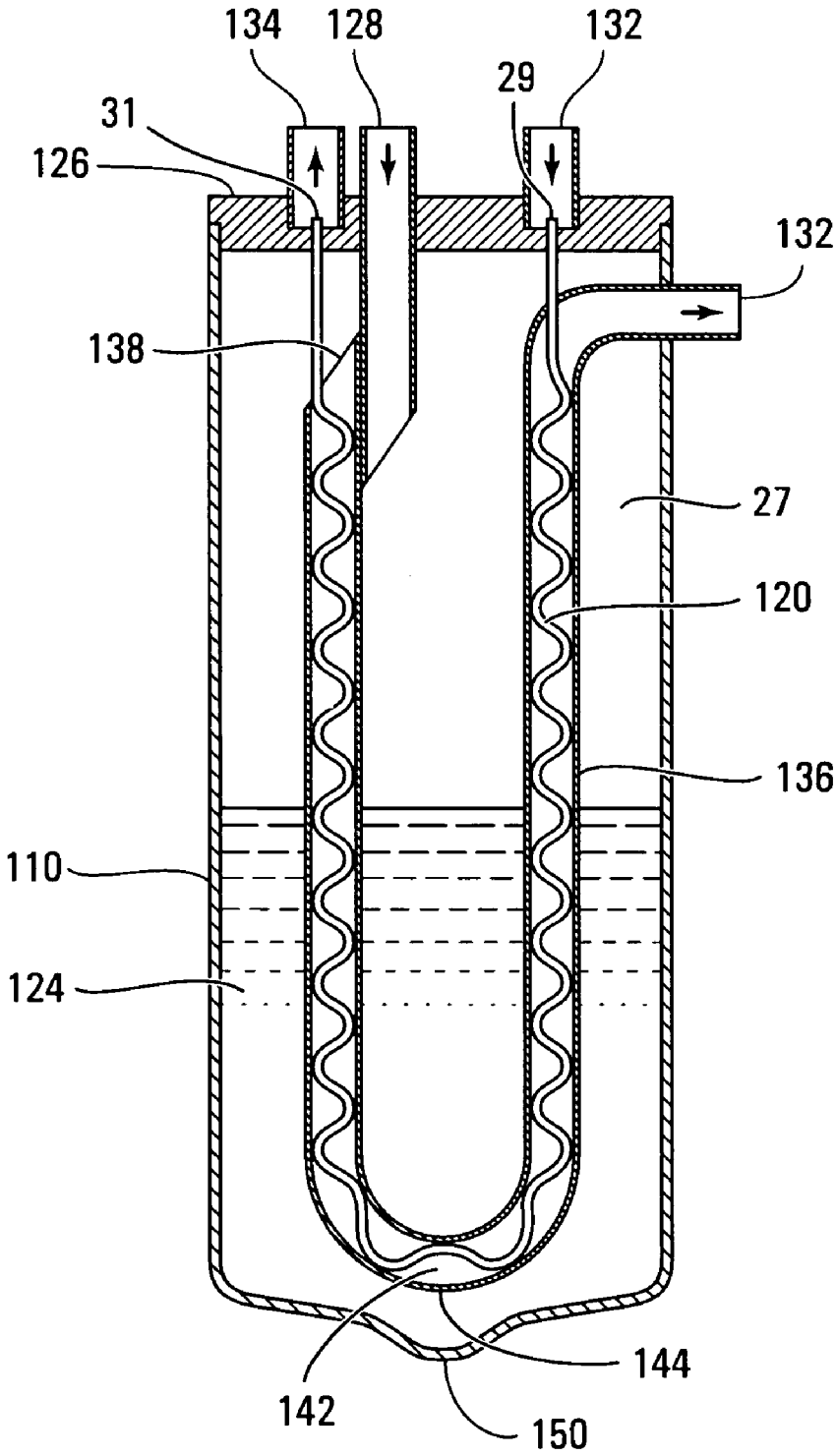
FIG. 5 is a cross-sectional view of an integrated accumulator-expander-heat exchanger of a second embodiment of the present invention.

Although FIG. 4 shows a favorable embodiment of the present invention, in which all of the fluid connections extend through the head fitting 26, other arrangements are possible, for example, as shown in FIG. 5 where an accumulator 110 has a low pressure inlet port 128, a high pressure inlet port 132 and a high pressure outlet port 134 arranged in a head fitting 126. A low pressure outlet port 130 extends through a wall of a container 124.

Figure 6:
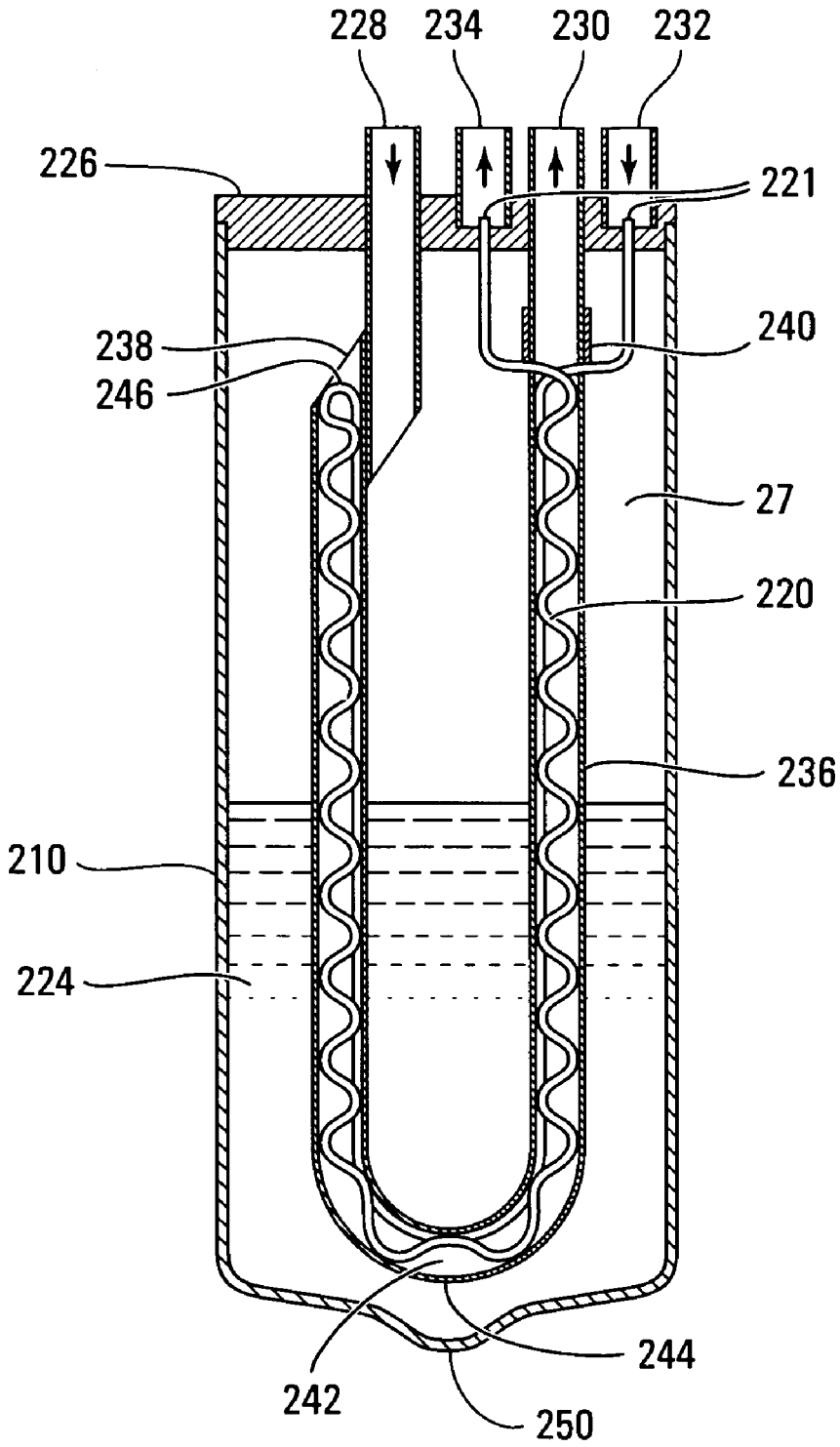
FIG. 6 is a cross-sectional view of an integrated accumulator-expander-heat exchanger of a third embodiment of the present invention.

A further possible embodiment is shown in FIG. 6. In FIG. 6, a capillary 220 is positioned inside a tube 236 with both ends 221 of the capillary positioned near a low pressure outlet port 230. The capillary 220 also has a turn 246 near a vapor inlet end 238 of the tube. Thus, in the capillary tube 220, refrigerant fluid flows in opposite directions before and after the turn 246. In this embodiment, the turn 246 may be positioned at any location inside the tube 236. The capillary tube 220 may have more than one turn. The capillary tube 220 may have any desired shape, such as the shape of wave, helix and straight line, or any combination of them. The capillary tube (s) 220 may have any of the features as described with respect to capillary tube 20.

Figure 7:
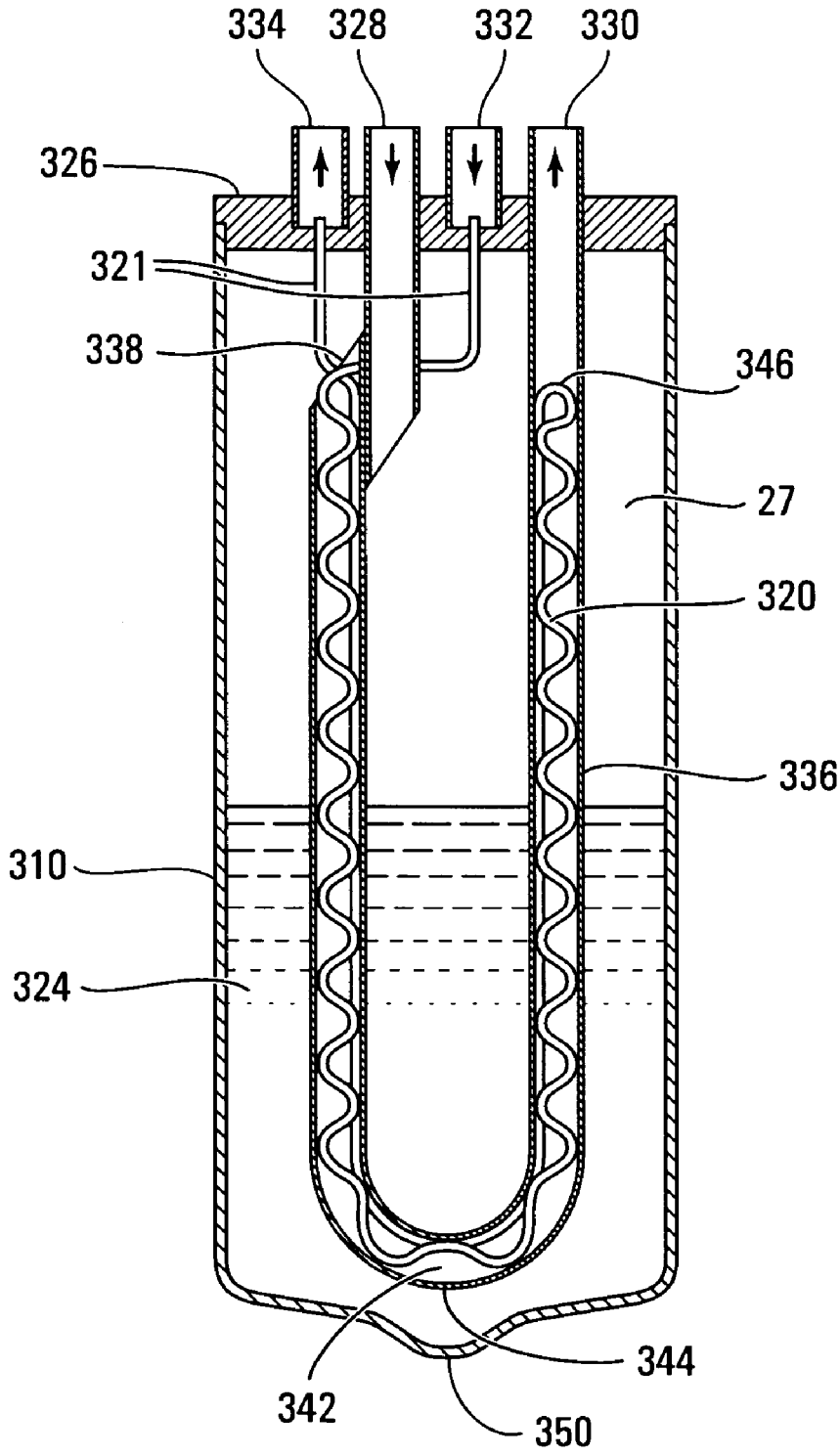
FIG. 7 is a cross-sectional view of an integrated accumulator-expander-heat exchanger of a fourth embodiment of the present invention.

FIG. 7 shows still another possible embodiment. In this case, a capillary 320 is positioned inside a tube 336 with both ends 321 near a vapor inlet end 338, and has a turn 346 near a low pressure outlet port 330. Thus, in the capillary tube 320, refrigerant fluid flows in opposite directions before and after the turn 346. As with the embodiment of FIG. 6, in this embodiment, the turn 346 may be positioned at any location inside the tube 336. The capillary may have any number of turns, and any desired shape and/or other features as described with respect to capillary tube 20.

The operation of accumulators 110, 210 and 310 of FIGS. 5 to 7 are otherwise the same as the operation of the accumulator 10 described in detail with respect to FIG. 4.

Figure 8A:
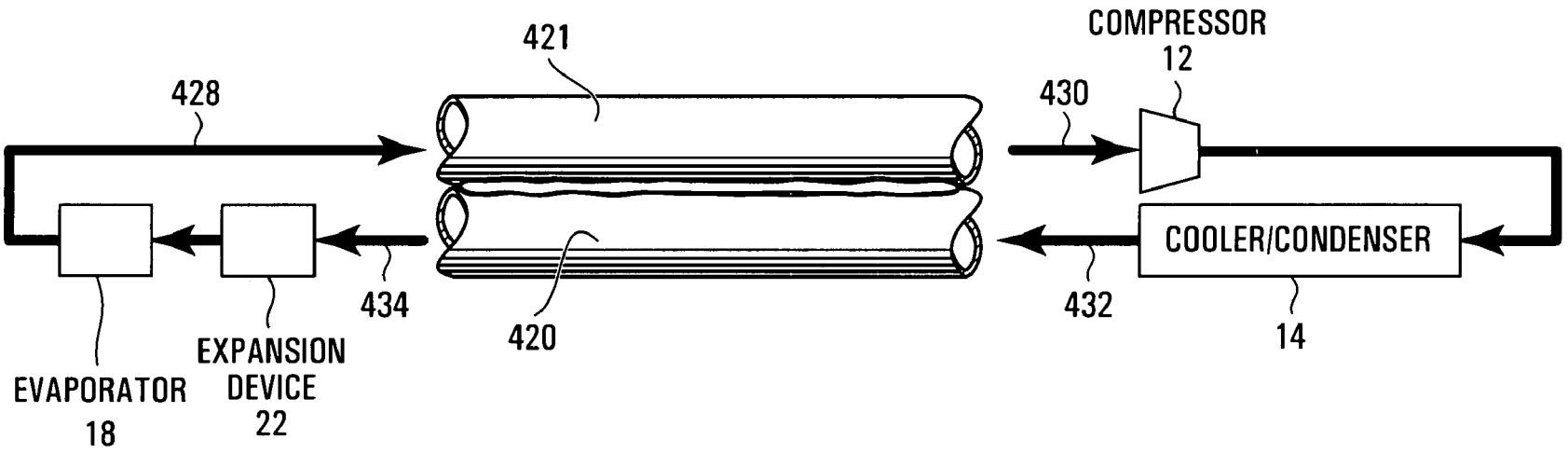
FIG. 8A is a partial top view of a heat exchanger of an embodiment of the present invention.
Figure 8B:
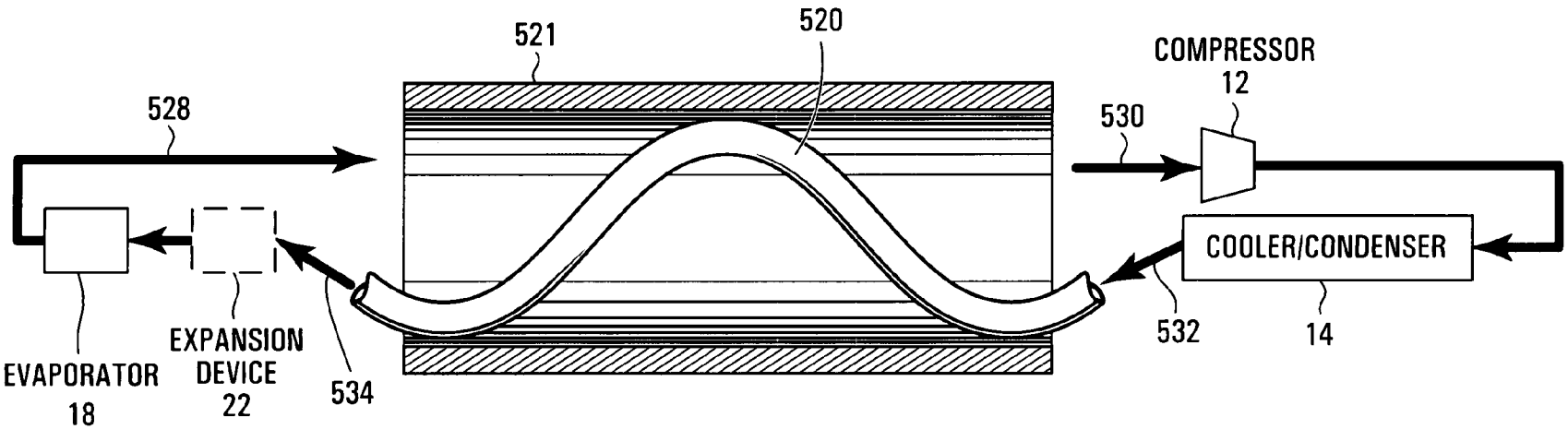
FIG. 8B is a partial cross-sectional view of a heat exchanger of another embodiment of the present invention.

FIGS. 8A and 8B depict an embodiment of the invention in which heat-transfer occurs outside an accumulator and an accumulator may optionally not be used. The refrigerating system of FIG. 2 or 3 is modified by removing the accumulator and instead placing the conduit which extends between the condenser 14 and the expansion device 22 and the conduit which extends between the evaporator 18 and the compressor 12 in heat transfer communication. In particular, FIG. 8A depicts a conduit 420 which extends between the condenser and the expansion device and a conduit 421 which extends between the evaporator and the compressor. Preferably, these conduits are comprised of metal (e.g. aluminum), although any suitable material of any acceptable cross-sectional shape may be used. These conduits are arranged in heat exchange relationship with each other. This may be achieved by placing the conduits in (intimate) contact with one another by, for example, welding, soldering or otherwise joining the two conduits together. This arrangement then takes the place of the tube 36 and capillary tube 20 depicted in FIGS. 4 through 7.

FIG. 8B shows another embodiment in which the arrangement of the conduits are similar to those depicted in FIG. 4 but are again independent of any accumulator. The inner conduit is a capillary/small-sized tube 520 and the outer conduit is a tube. The inner conduit may be sized to function as an expander (as for example described above in connection with the capillary tube 20), in which case a separate expansion device may be omitted. Alternatively, the inner tube may be sized not to provide any significant pressure drop in the refrigerant, in which case a separate expansion device 22 is required.

Inputs and outputs 428 to 434 and 528 to 534 are as described in respect to inputs and outputs 28 to 34 in regard to FIG. 4. Similar arrangements of tubes may be provided as described in regard to capillary tube 20. In operation, the fluid flowing from the condenser to the evaporator and the fluid flowing from the evaporator to the compressor undergo heat transfer when the conduits carrying the fluid are in heat transfer contact as shown in FIGS. 8A and 8B. The embodiments of FIGS. 8A and 8B are particularly applicable to automotive air-conditioning systems.

In one embodiment, the heat exchange relationship between the conduits may extend to a position close to or at the compressor and/or the outlet of the cooler/condenser to assist in increasing the heat transfer between the refrigerant paths.

Figure 9:
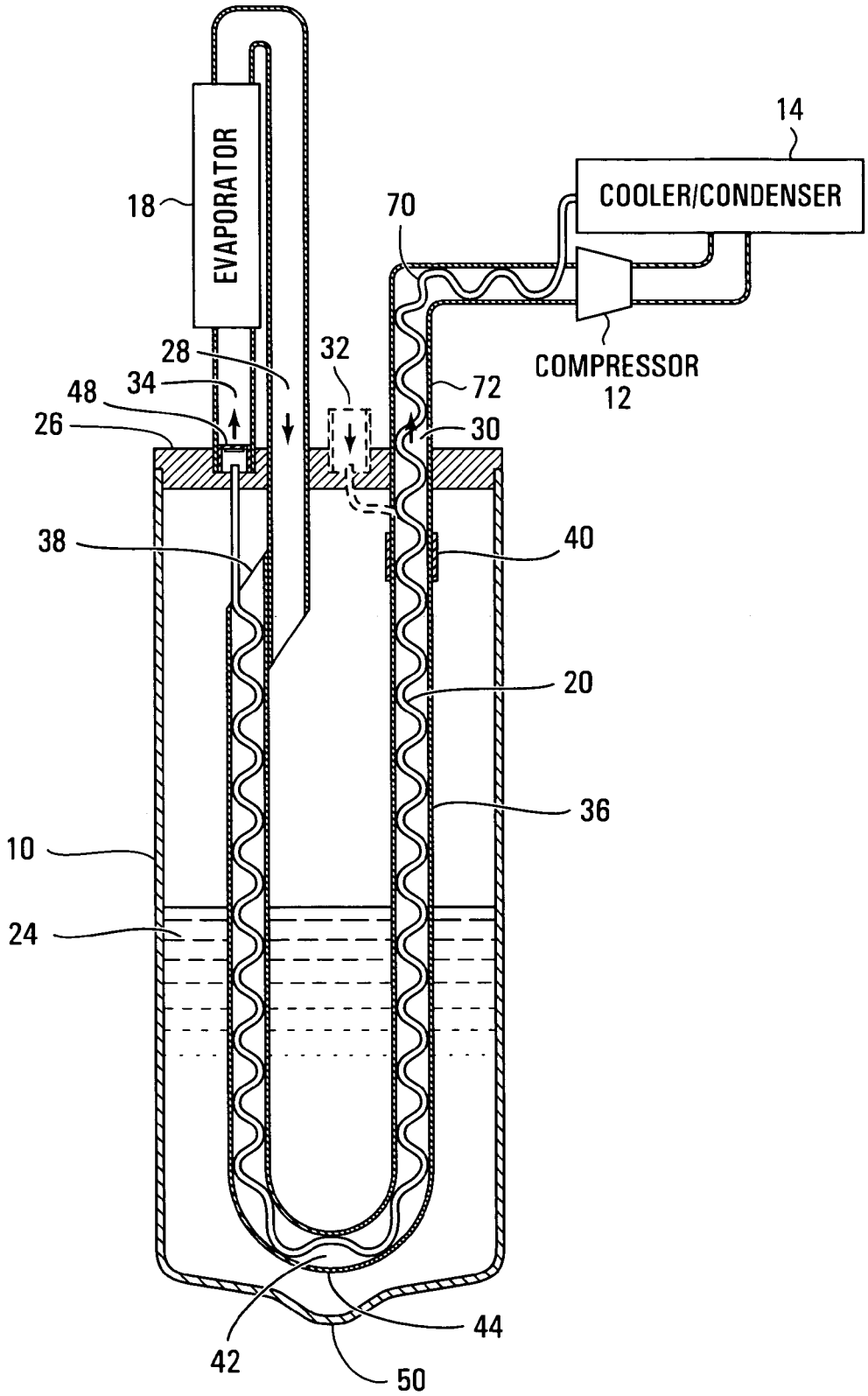
FIG. 9 shows a cross-sectional view of an integrated accumulator-expander-heat exchanger according to another embodiment of the present invention.

FIG. 9 shows an accumulator according to another embodiment of the present invention. The accumulator is similar to that described above with reference to FIG. 4, and like parts are designated by the same reference numerals. Thus, the description of the accumulator shown in FIG. 4 applies equally to the accumulator shown in FIG. 9. One of the main differences between the embodiment of FIG. 9 and that shown in FIG. 4 is that the embodiment of FIG. 9 includes a valve 48 for controlling the flow of fluid into the evaporator. The valve comprises one or more orifices whose size can be varied to control the flow of fluid. The ability to adjust the flow rate into the evaporator has important benefits in certain applications, for example, where the compressor speed can vary. Once such application is in automobiles where the compressor is driven by the engine and therefore compressor speed is dependent on the engine speed. When idling (i.e. the engine speed is low), the flow of fluid through the refrigeration circuit decreases in comparison with cruising speeds, and therefore the cooling capacity of the refrigeration system is reduced. However, the heat load on the system may be the same or may be even higher when a vehicle is stationary. Advantageously, the provision of a variable valve allows the impedance, and therefore, the pressure drop across the expansion device to be increased to lower the temperature of refrigerant entering the evaporator, thereby compensating for the reduced fluid flow caused by slower compressor speeds. Conveniently, the valve may be controlled in response to a parameter indicative of the performance of the refrigeration system, such as the temperature of the evaporator (or fluid pressure). The valve may comprise a temperature sensitive actuator which senses the local temperature at the port 28 and activates the valve accordingly.

Figure 10A:
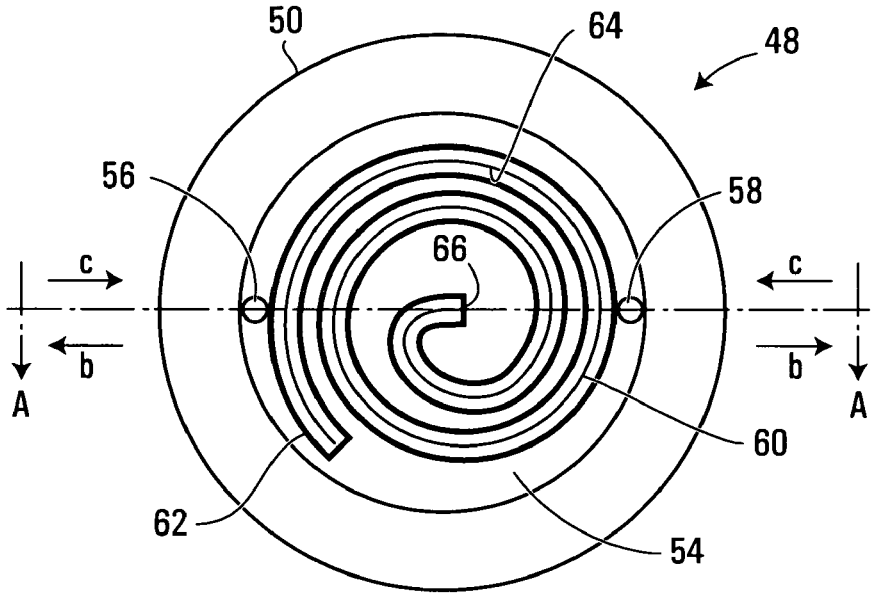
FIG. 10A shows a plan view of a valve according to an embodiment of the present invention.
Figure 10B:
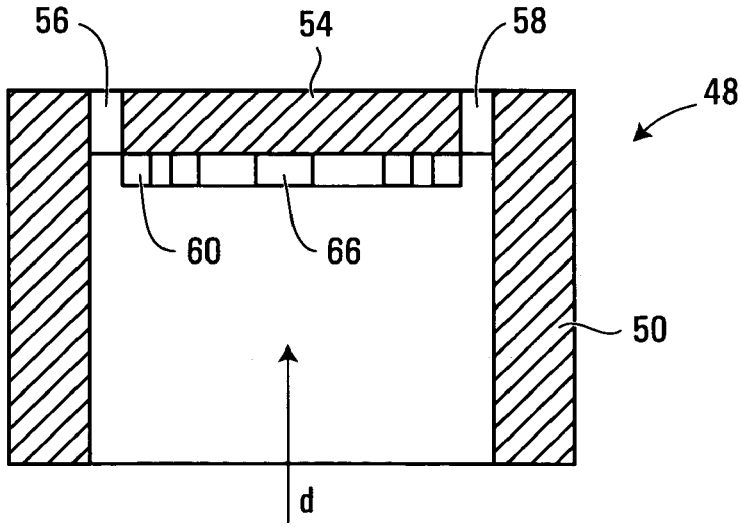
FIG. 10B shows a cross-section of the valve shown in FIG. 10A along the line A-A.

A valve according to an embodiment of the present invention is shown in FIGS. 10A and 10B.

Referring to FIGS. 10A and 10B, a valve 60 comprises a support 50, which in this embodiment comprises a cylindrical wall. The valve further comprises a transverse portion 54 which extends across the cylindrical support 50, and which in this embodiment is in the form of a disc or plate. First and second orifices 56, 58 are formed in the transverse portion 54 to allow fluid to pass therethrough. The valve further comprises a valve element 60 mounted on the transverse portion for controlling the amount by which the orifices 56, 58 are open or closed.

In this embodiment, the valve element 60 is in the form of an elongate spiral strip and comprises two longitudinal elements 62, 64, one of which 62 is positioned on the outside of the spiral and the other 64 is positioned on the inside of the spiral. In this embodiment, the elements are arranged such that when the temperature increases, the spiral element moves outwardly towards the two orifices 56, 58 in the direction of arrows "b", and when the temperature decreases, the spiral element moves inwardly away from the orifices 56, 58, as indicated by arrows "c". To implement this arrangement, the inner element 64 may comprise a material having a lower coefficient of thermal expansion than the outer element 62 so that when the temperature increases, the inner element tends to reduce the tightness of curvature of the spiral so that the valve element moves over the orifices 56, 58, and when the temperature decreases, the inner element contracts more than the outer element tending to increase the tightness of curvature of the spiral, thereby moving the valve element away from the orifices and towards the centre of the spiral. The valve element 60 may be mounted so that its outer portions which control the orifice size are free to slide relative to the transverse portion 54, and to effect this, the spiral element may be fixedly mounted to the transverse element in a central region thereof, for example region 66. Any suitable means of fastening the valve element to the transverse portion 54 may be used, for example welding, solder, adhesive or any suitable mechanical fastener such as a screw, rivet or other mechanical device.

The inner and outer valve elements 62, 64 may comprise any suitable material or may comprise any suitable structure which provides differential expansion and contraction between the inner and outer portions of the spiral strip. For example, the inner element 64 may comprise copper, aluminum or other material, and the outer element may comprise for example Invar™ or Kovar™, or other suitable material.

Although the valve 48 may be mounted with the valve element on the low pressure side of the orifice(s), it may be advantageous to mount the valve element on the high pressure side, as shown in FIG. 10B, as the transverse portion 54 assists in supporting the valve element 62 to minimize deflection thereof caused by flow and pressure of fluid which have a direction indicated by arrow "d" shown in FIG. 10B, and which act in the same direction as the fastener for fastening the valve element to the transverse element 54.

It will be appreciated that in other embodiments, the valve may comprise any number of orifices, for example, a single orifice or more than two orifices. The orifices may have any desired cross-sectional shape, such circular, triangular, quadrilateral, or any combination of them. Although in this embodiment, the orifices are placed adjacent the outer edge of the transverse element, in other embodiments, one or more orifices may be positioned elsewhere, for example, at any intermediate position between the outer edge and centre of the transverse element. In another embodiment, the spiral element may be adapted to contract when the temperature increases and expand when the temperature decreases so that it moves across the orifice in response to temperature changes in the opposite manner described above.

Advantageously, the configuration of the valve according to the above embodiments is compact and can be easily mounted into the upper plate of the accumulator, as shown in FIG. 9. Furthermore, this configuration allows the valve to be manufactured using very few parts, and is therefore simple and cheap to manufacture and also robust and reliable.

Although in some embodiments, an expansion valve such as one described above in conjunction with FIGS. 9, 10A and 10B may be positioned on the inlet side of the conduit 20, in other embodiments, the expansion valve is placed on the outlet side of the conduit 20, as shown in FIG. 9. In this way, the valve is nearer to the evaporator and can sense temperature changes in the evaporator directly without requiring any additional means of conveying this control parameter to the expansion valve.

An expansion device comprising the combination of a restrictive conduit (for example a capillary tube) and a restrictive orifice causes the overall pressure drop across the expansion device to be shared between these two elements, i.e. the conduit and orifice. Advantageously, as the restrictive orifice produces its own pressure drop, and therefore all of the pressure drop across the expansion device is not attributed solely to the restrictive conduit, the combination allows the restrictive conduit to have a lower impedance than it would otherwise need. In turn, this allows the internal cross-section of the restrictive conduit to be enlarged, resulting in a larger circumference and conduit wall surface area for increased heat exchange with fluid from the evaporator. In this way, the synergy of the combination of a restrictive conduit and a restrictive orifice provide an expansion device having a higher efficiency. It is to be noted that the benefits of this combination are achieved regardless of whether or not a valve is provided for controlling the size of the restrictive orifice, and embodiments may be implemented using the combination of a restrictive conduit and simple restrictive orifice without any valve element. Alternatively, or in addition, this combination allows the length of the restrictive conduit to be reduced so that it takes up less space.

It will be appreciated that while in FIG. 9, the enclosure 36 and conduit 20 are positioned within the accumulator chamber, these elements may be positioned outside the accumulator chamber, and may or may not be arranged in such a way that the enclosure 36 is in heat exchange relationship with fluid in the chamber.

Where in other embodiments, the enclosure 36 is omitted, the restrictive conduit 20 may reside either within the accumulator chamber or externally thereof and in heat exchange relationship with fluid in the chamber, and in particular with the gaseous/two-phase fluid.

Referring again to FIG. 9, in one optional implementation, the conduit which carries refrigerant fluid from the cooler/condenser 14 to the accumulator is positioned in heat exchange relationship with the conduit which carries fluid from the accumulator to the compressor 12. Advantageously, this extends the heat exchange relationship between the two fluid paths and promotes further cooling of high pressure fluid between the condenser and the accumulator, and further heating of low pressure fluid between the accumulator and the compressor, for improved efficiency.

The tube 70 may be a capillary tube or an ordinary tube with no significant impedance. The tubes/conduits 70, 72, may be arranged in any way to effect heat exchange therebetween.

Experiments have shown that embodiments of the present system, having an integrated accumulator-expander heat exchanger similar to that shown in FIG. 4, and implemented as an air conditioning system provide increased COP's of ca. 15%, and higher cooling loads of ca. 14% in comparison to another air conditioner using the same compressor, evaporator, condenser, and the same capillary tube as expansion device. Compressor speeds used in the experiments were 700, 1500 and 2000rpm, which generally correspond to idle, local and highway driving, respectively.

Within the ambits of the invention significant changes can be made in the dimensions, shapes, sizes, orientations and materials to meet the specific requirements of the air-conditioning system that is being designed. Likewise the external structure such as the head fitting, the container, the position and arrangement of inlet and outlet ports can be modified as desired.

It should be understood that while for clarity certain features of the invention are described in the context of separate embodiments, these features may also be provided in combination in a single embodiment. Furthermore, various features of the invention that for brevity are described in the context of a single embodiment may also be provided separately or in any suitable sub-combination in other embodiments.

Moreover, although particular embodiments of the invention have been described and illustrated herein, it will be recognized that modifications and variations may readily occur to those skilled in the art, and consequently it is intended that the claims appended hereto be interpreted to cover all such modifications and equivalents.

The invention claimed is:

1. An apparatus for a refrigeration system comprising an accumulator having a chamber for receiving refrigerant;

an expander for expanding refrigerant and disposed in said chamber, wherein said expander comprises a conduit for carrying refrigerant therethrough, said conduit having an impedance over at least a portion of its length to produce a pressure drop in fluid therealong; an enclosure in said chamber for carrying gaseous and/or two-phase refrigerant therealong, said enclosure being defined by an enclosure wall and having a fluid inlet, a fluid outlet, and a portion disposed in a lower portion of said accumulator, the lower portion of the enclosure having one or more bleed holes formed therein for introducing fluid from said chamber into said enclosure, and wherein a major surface area of said conduit is in heat exchange relationship with the interior of said enclosure.

2. An apparatus as claimed in claim 1, wherein said expander conduit is disposed in said enclosure.

3. An apparatus as claimed in claim 1, wherein said enclosure comprises a conduit.

4. An apparatus for a refrigeration system, comprising an accumulator having a chamber for receiving refrigerant;

an enclosure in said chamber, said enclosure being defined by an enclosure wall and having a fluid inlet and a fluid outlet, said accumulator chamber having upper and lower portions, said enclosure extending between said upper and lower portions of the accumulator chamber, and having a lower portion disposed in the lower portion of said chamber, an aperture being formed in the lower portion of said enclosure for introducing fluid from the interior of said chamber into said enclosure;

an expander for expanding refrigerant and disposed in said enclosure, wherein said expander comprises a conduit for carrying refrigerant therethrough, said conduit having an impedance over at least a portion of its length to produce a pressure drop in fluid therealong; and separating means for separating refrigerant gas from refrigerant liquid and for introducing refrigerant gas into the inlet of said enclosure, wherein said separating means comprises a fluid inlet for introducing fluid into said chamber and which is positioned to prevent fluid flowing through said inlet into said chamber from flowing directly into the inlet of said enclosure.

5. An apparatus for a refrigeration system, comprising an accumulator having a chamber for receiving refrigerant;

an enclosure in said chamber, said enclosure being defined by an enclosure wall and having a fluid inlet and a fluid outlet, said accumulator chamber having upper and lower portions, said enclosure extending between said upper and lower portions of the accumulator chamber, and having a lower portion disposed in the lower portion of said chamber, an aperture being formed in the lower portion of said enclosure for introducing fluid from the interior of said chamber into said enclosure;

an expander for expanding refrigerant and disposed in said enclosure, wherein said expander comprises a conduit for carrying refrigerant therethrough, said conduit having an impedance over at least a portion of its length to produce a pressure drop in fluid therealong; and an expansion device defining one or more restrictive orifices sized to increase the impedance of fluid flow above the impedance provided by said expander conduit.

6. An apparatus as claimed in claim 5, further comprising valve means for varying the size of at least one orifice.

7. An apparatus for a refrigeration system, comprising an accumulator having a chamber for receiving refrigerant;

an enclosure in said chamber, said enclosure being defined by an enclosure wall and having a fluid inlet and a fluid outlet, said accumulator chamber having upper and lower portions, said enclosure extending between said upper and lower portions of the accumulator chamber, and having a lower portion disposed in the lower portion of said chamber, an aperture being formed in the lower portion of said enclosure for introducing fluid from the interior of said chamber into said enclosure;

an expander for expanding refrigerant and disposed in said enclosure, wherein said expander comprises a conduit for carrying refrigerant therethrough, said conduit having an impedance over at least a portion of its length to produce a pressure drop in fluid therealong; and a further conduit for carrying fluid from said accumulator to a compressor and a return conduit for feeding fluid from said compressor to said accumulator and wherein said further and return conduits are in heat exchange relationship.

8. An apparatus as claimed in claim 7, wherein at least one of (1) the walls of the further and return conduits are in contact with one another and (2) one of said further conduit and said return conduit is inside the other of said further conduit and said return conduit.

9. An apparatus for a refrigeration system, comprising an accumulator having a chamber for receiving refrigerant;

an enclosure in said chamber, said enclosure being defined by an enclosure wall and having a fluid inlet and a fluid outlet, said accumulator chamber having upper and lower portions, said enclosure extending between said upper and lower portions of the accumulator chamber, and having a lower portion disposed in the lower portion of said chamber, an aperture being formed in the lower portion of said enclosure for introducing fluid from the interior of said chamber into said enclosure;

an expander for expanding refrigerant and disposed in said enclosure, wherein said expander comprises a conduit for carrying refrigerant therethrough, said conduit having an impedance over at least a portion of its length to produce a pressure drop in fluid therealong; wherein said conduit has an impedance which is distributed over a substantial portion of its length in said chamber.

10. An apparatus for a refrigeration system comprising an accumulator having a chamber for receiving refrigerant, and expansion means for expanding refrigerant, the expansion means comprising a conduit for carrying fluid therethrough and being arranged for exchanging heat with refrigerant in said chamber, said conduit having an impedance over at least a portion of its length to produce a pressure drop in fluid therealong, said expansion means further comprising means for defining one or more restrictive orifice sized to increase the impedance of fluid flow above the impedance provided by said conduit, and valve means, responsive to a parameter to vary the size of at least one orifice.

11. An apparatus as claimed in claim 10, wherein said parameter comprises at least one of temperature and pressure.

12. An apparatus as claimed in claim 10, wherein said valve means comprises structure which displaces as a result of changes in temperature of the structure.

13. An apparatus as claimed in claim 12, wherein said structure comprises an element capable of assuming a curve along its length and wherein the tightness of an assumed curve is varied by temperature such that the tightness of curvature is varied in a plane which extends across said orifice.

14. An apparatus as claimed in claim 13, wherein said element comprises a first element comprising a first material and a second element comprising a second material wherein the first material has a different coefficient of thermal expansion than that of said second material and said elements are positioned side by side in said plane.

15. An apparatus as claimed in claim 14, wherein said element comprises an elongate strip formed as a spiral.

16. An apparatus as claimed in claim 15, wherein said element is mounted such that said element overlaps said orifice to vary the size of said orifice.

17. An apparatus for a refrigeration system comprising an accumulator having a chamber for receiving refrigerant, an expander for expanding refrigerant comprising a conduit for carrying fluid therethrough, said conduit having an impedance over at least a portion of its length to produce a pressure drop in fluid therealong, and a controller responsive to a parameter to control the impedance of the expander, wherein said controller comprises valve means for controlling the flow of fluid therethrough.

18. An apparatus as claimed in claim 17, wherein said conduit is disposed within said chamber.

19. An apparatus as claimed in claim 18, further comprising an enclosure being defined by an enclosure wall and having a fluid inlet and a fluid outlet, and wherein the expander conduit is disposed in said enclosure.

20. An apparatus as claimed in claim 17, wherein said expander conduit has an inlet and an outlet, and wherein said valve means is positioned proximate the outlet.

21. An expansion device for a refrigeration system, the expansion device having one or more restrictive orifices, a valve element for varying the size of at least one orifice, wherein the valve element is capable of assuming a curve along its length, the assumed curve having a tightness, and wherein the tightness of the assumed curve of said element is varied by temperature such that the tightness of the assumed curve is varied in a plane which extends across the orifice.

22. An expansion device as claimed in claim 21, comprising a transverse member, said one or more restrictive orifices being formed in said transverse member, and wherein said valve element is positioned against said transverse member.

23. An expansion device as claimed in claim 21, wherein said valve element comprises a first element comprising a first material and a second element comprising a second material, wherein said first material has a different coefficient of expansion than that of the second material, and said elements are positioned side by side in said plane.

24. An expansion device as claimed in claim 23, wherein said valve element comprises an elongate strip formed as a spiral.

25. An expansion device as claimed in claim 22, wherein said one or more restrictive orifices each has a high pressure side and a low pressure side, and said valve element is positioned on the high pressure side.

26. An apparatus for a refrigeration system, comprising an accumulator having a chamber for receiving refrigerant;

an enclosure in said chamber, said enclosure being defined by an enclosure wall and having a fluid inlet and a fluid outlet, said accumulator chamber having upper and lower portions, said enclosure extending between said upper and lower portions of the accumulator chamber, and having a lower portion disposed in the lower portion of said chamber, an aperture being formed in the lower portion of said enclosure for introducing fluid from the interior of said chamber into said enclosure;

an expander for expanding refrigerant and disposed in said enclosure, wherein said expander comprises a conduit for carrying refrigerant therethrough, said conduit having an impedance over at least a portion of its length to produce a pressure drop in fluid therealong; wherein said enclosure comprises a first portion defining a downwardly directed flow passage for refrigerant between said upper portion of said accumulator chamber and said lower portion of said enclosure, and a second portion defining an upwardly directed flow passage for said refrigerant from said lower portion of said enclosure towards said upper portion of said accumulator chamber.

27. An apparatus for a refrigeration system, comprising an accumulator having a chamber for receiving refrigerant;

an enclosure in said chamber, said enclosure being defined by an enclosure wall and having a fluid inlet and a fluid outlet, said accumulator chamber having upper and lower portions, said enclosure extending between said upper and lower portions of the accumulator chamber, and having a lower portion disposed in the lower portion of said chamber, an aperture being formed in the lower portion of said enclosure for introducing fluid from the interior of said chamber into said enclosure;

an expander for expanding refrigerant and disposed in said enclosure, wherein said expander comprises a conduit for carrying refrigerant therethrough, said conduit having an impedance over at least a portion of its length to produce a pressure drop in fluid therealong; wherein said enclosure comprises a conduit, and said enclosure conduit includes a first arm defining a downwardly directed flow path for refrigerant between said upper portion of said accumulator chamber and said lower portion of said enclosure, and a second arm defining an upwardly directed flow path for said refrigerant from said lower portion of said enclosure towards said upper portion of said accumulator.

28. An apparatus as claimed in claim 1, wherein said expander conduit comprises a capillary tube.

29. An apparatus, as claimed in claim 1, wherein said expander conduit is non-linear along at least a portion of its length in said enclosure.

30. An apparatus as claimed in claim 29, wherein said expander conduit defines a spiral or a meander shape along at least a portion of its length in said enclosure.

* * * * *